US010561235B1

(12) United States Patent
Abbott et al.

(10) Patent No.: US 10,561,235 B1
(45) Date of Patent: Feb. 18, 2020

(54) MOTORIZED SHELF ASSEMBLY

(71) Applicant: Superior Motorized Shelving Systems, LLC, Carlsbad, CA (US)

(72) Inventors: Nicholas J Abbott, Carlsbad, CA (US); Rick Lee Taylor, Sylmar, CA (US)

(73) Assignee: SUPERIOR MOTORIZED SHELVING SYSTEMS, LLC, Carlsbad, CA (US)

( * ) Notice: Subject to any disclaimer, the term of this patent is extended or adjusted under 35 U.S.C. 154(b) by 0 days.

(21) Appl. No.: 16/118,562

(22) Filed: Aug. 31, 2018

Related U.S. Application Data

(63) Continuation-in-part of application No. 16/042,964, filed on Jul. 23, 2018, which is a continuation of application No. 15/354,326, filed on Nov. 17, 2016, now Pat. No. 10,034,540.

(60) Provisional application No. 62/259,792, filed on Nov. 25, 2015.

(51) Int. Cl.
*A47B 46/00* (2006.01)
*A47B 51/00* (2006.01)
*A47B 77/10* (2006.01)

(52) U.S. Cl.
CPC ..... *A47B 46/005* (2013.01); *A47B 51/00* (2013.01); *A47B 77/10* (2013.01); *A47B 2220/0097* (2013.01)

(58) Field of Classification Search
CPC ..... A47B 46/005; A47B 51/00; A47B 77/00; A47B 2220/0097
See application file for complete search history.

(56) References Cited

U.S. PATENT DOCUMENTS

| | | | | |
|---|---|---|---|---|
| 2,635,030 A | | 4/1953 | Stebbins | |
| 2,938,631 A | | 5/1960 | Brey | |
| 3,857,623 A | | 12/1974 | Schneller | |
| 4,150,861 A | | 4/1979 | Dufrancatel | |
| 4,195,461 A | | 4/1980 | Thiis-Evensen | |
| 4,915,461 A | * | 4/1990 | Kingsborough | A47B 77/10 312/247 |
| 5,026,129 A | | 6/1991 | Merl | |
| 5,224,677 A | | 7/1993 | Close | |
| 5,249,858 A | | 10/1993 | Nusser | |
| 5,308,158 A | | 5/1994 | Vogelgesang et al. | |

(Continued)

FOREIGN PATENT DOCUMENTS

JP 2008141923 6/2008

*Primary Examiner* — Hanh V Tran
(74) *Attorney, Agent, or Firm* — Shlesinger, Arkwright & Garvey LLP

(57) ABSTRACT

A cabinet includes a first shelf disposed inside the cabinet at a height above waist level, the first shelf having a first retracted position and a first deployed position below and outwardly from the first retracted position; a first parallelogram linkage pivotally operably attached to a first end of the first shelf and the cabinet; a second parallelogram linkage pivotally operably attached to the cabinet and a second end of the first shelf; a first shaft having a first end operably engaged with the first parallelogram linkage, the first shaft having a second end operably engaged with the second parallelogram linkage; and a drive motor operably engaged with the first shaft to operate the first and second parallelogram linkages outwardly and downwardly to position the first shelf from the first retracted position to the first deployed position.

20 Claims, 15 Drawing Sheets

(56) References Cited

U.S. PATENT DOCUMENTS

| | | | | |
|---|---|---|---|---|
| 5,758,782 | A | 6/1998 | Rupert | |
| 6,073,624 | A | 6/2000 | Laurent | |
| 6,209,405 | B1 * | 4/2001 | Milsem | A47B 46/00 74/89.21 |
| 6,340,214 | B1 | 1/2002 | Adams | |
| 6,976,598 | B2 | 12/2005 | Engel | |
| 7,654,208 | B2 * | 2/2010 | Patten | A47B 46/005 108/138 |
| 7,731,805 | B2 * | 6/2010 | Banta | A47L 15/506 134/56 D |
| 7,743,930 | B2 | 6/2010 | Krohn | |
| 8,061,789 | B2 * | 11/2011 | Krueger | A47B 61/00 211/100 |
| 8,414,093 | B2 | 4/2013 | Moran | |
| 8,424,693 | B1 | 4/2013 | Hoover | |
| 8,424,983 | B1 | 4/2013 | Strauss et al. | |
| 8,777,338 | B2 | 7/2014 | Bunch | |
| 9,055,813 | B2 | 6/2015 | Telthorster et al. | |
| 2007/0236114 | A1 | 10/2007 | Fuentes | |
| 2011/0266937 | A1 | 11/2011 | Roberts | |
| 2014/0175962 | A1 | 6/2014 | Hollenstein | |
| 2014/0203692 | A1 | 7/2014 | Marsters | |
| 2014/0263122 | A1 | 9/2014 | Roberts et al. | |

* cited by examiner

MOTORIZED SHELF ASSEMBLY

RELATED APPLICATIONS

This is a continuation-in-part of Nonprovisional application Ser. No. 16/042,964, filed Jul. 23, 2018, which is a continuation of Nonprovisional application Ser. No. 15/354,326, filed Nov. 17, 2016, now U.S. Pat. No. 10,034,540, which claims the priority benefit of Provisional Application Ser. No. 62/259,792, filed on Nov. 25, 2015. All the above mentioned applications are hereby incorporated by reference.

FIELD OF THE INVENTION

The present invention relates to motorized shelf assemblies.

SUMMARY OF THE INVENTION

The present invention provides a cabinet, comprising a first shelf disposed inside the cabinet at a height above waist level, the first shelf having a first retracted position and a first deployed position below and outwardly from the first retracted position; first and second pivot arms, first ends of the first and second pivot arms are pivotally operably attached to a first end of the first shelf, second ends of the first and second pivot arms are pivotally operably attached to the cabinet, the first and second pivot arms forming a first parallelogram; third and fourth pivot arms, first ends of the third and fourth pivot arms are pivotally operably attached to a second end of the first shelf, second end of the third and fourth pivot arms are pivotally operably attached to the cabinet, the third and fourth pivot arms forming a second parallelogram; a first shaft having a first end operably engaged with one of the second ends of the first and second pivot arms, the first shaft having a second end operably engaged with one of the second ends of the third and fourth pivot arms; and a drive motor operably engaged with the first shaft to pivot the first and second pivot arms and the third and fourth pivot arms to swing the first and the second parallelograms outwardly and downwardly to position the first shelf from the first retracted position to the first deployed position.

The present invention also provides a shelf retrofit for a cabinet hung from a wall, comprising a U-shaped frame having a base and first and second sides extending transversely from the base; first and second pivot arms, first ends of the first and second pivot arms are for being pivotally operably attached to a first end of a first shelf, second ends of the first and second pivot arms are pivotally operably attached to the first side, the first and second pivot arms forming a first parallelogram; third and fourth pivot arms, first ends of the third and fourth pivot arms are for being pivotally operably attached to a second end of the first shelf, second end of the third and fourth pivot arms are pivotally operably attached to the second side, the third and fourth pivot arms forming a second parallelogram; a first shaft operably attached to the base, the first shaft having a first end operably engaged with one of the second ends of the first and second pivot arms, the first shaft having a second end operably engaged with one of the second ends of the third and fourth pivot arms; and a drive motor operably attached to the base, the drive motor is engaged with the first shaft to pivot the first and second pivot arms and the third and fourth pivot arms to swing the first and the second parallelograms outwardly and downwardly for positioning the first shelf from a retracted position to a deployed position.

The present invention also provides a cabinet, comprising a first shelf disposed inside the cabinet at a height above waist level, the first shelf having a first retracted position and a first deployed position below and outwardly from the first retracted position; a first parallelogram linkage pivotably operably attached to a first end of the first shelf and the cabinet; a second parallelogram linkage pivotally operably attached to the cabinet and a second end of the first shelf; a first shaft having a first end operably engaged with the first parallelogram linkage, the first shaft having a second end operably engaged with the second parallelogram linkage; and a drive motor operably engaged with the first shaft to operate the first and second parallelogram linkages outwardly and downwardly to position the first shelf from the first retracted position to the first deployed position.

DETAILED DESCRIPTION OF THE INVENTION

Figure 1:
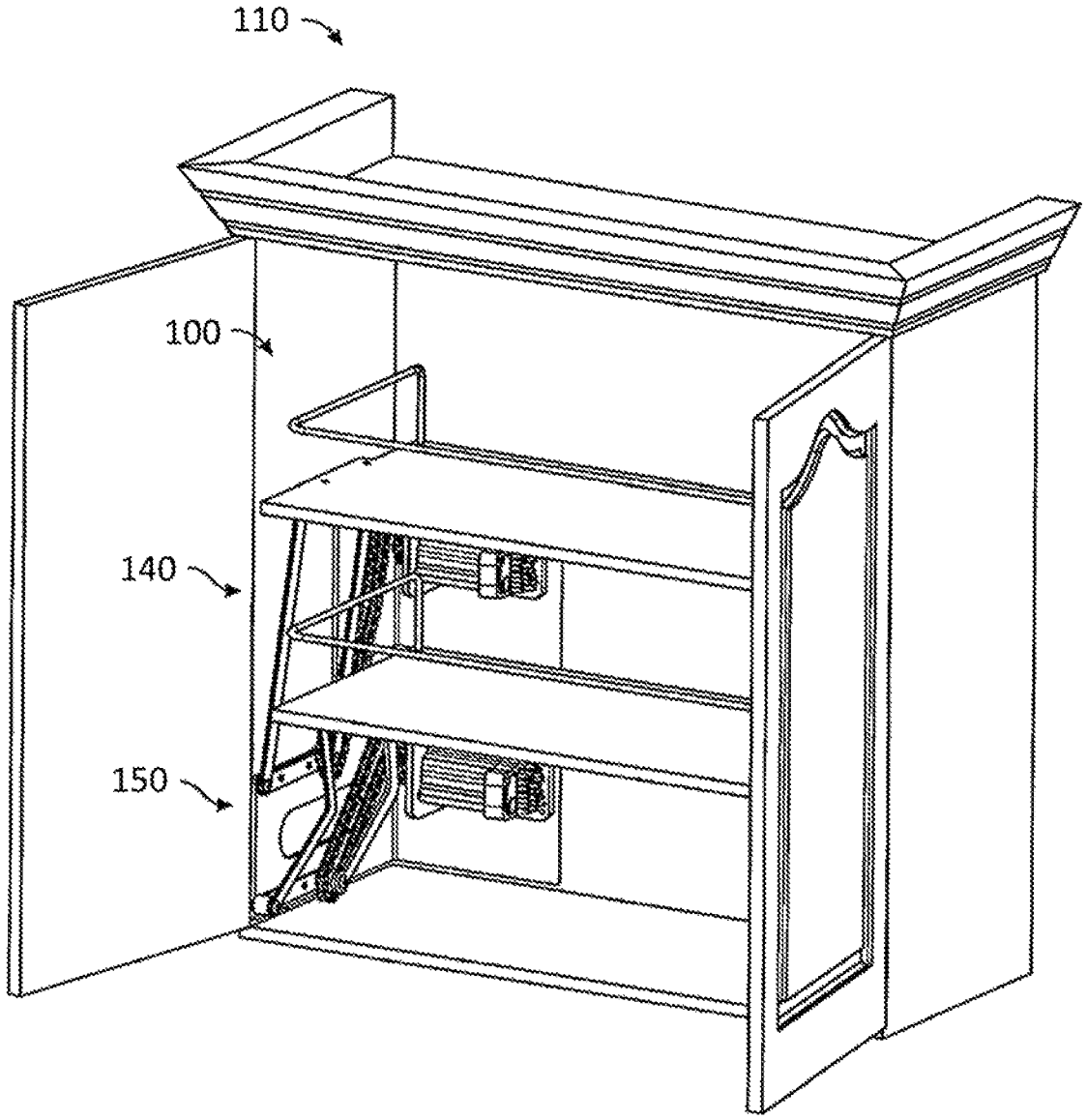
FIG. 1 is a perspective view of an embodiment of a motorized shelf assembly in a cabinet with both upper and lower shelf assemblies shown in the "up" or "retracted" position.
Figure 2:
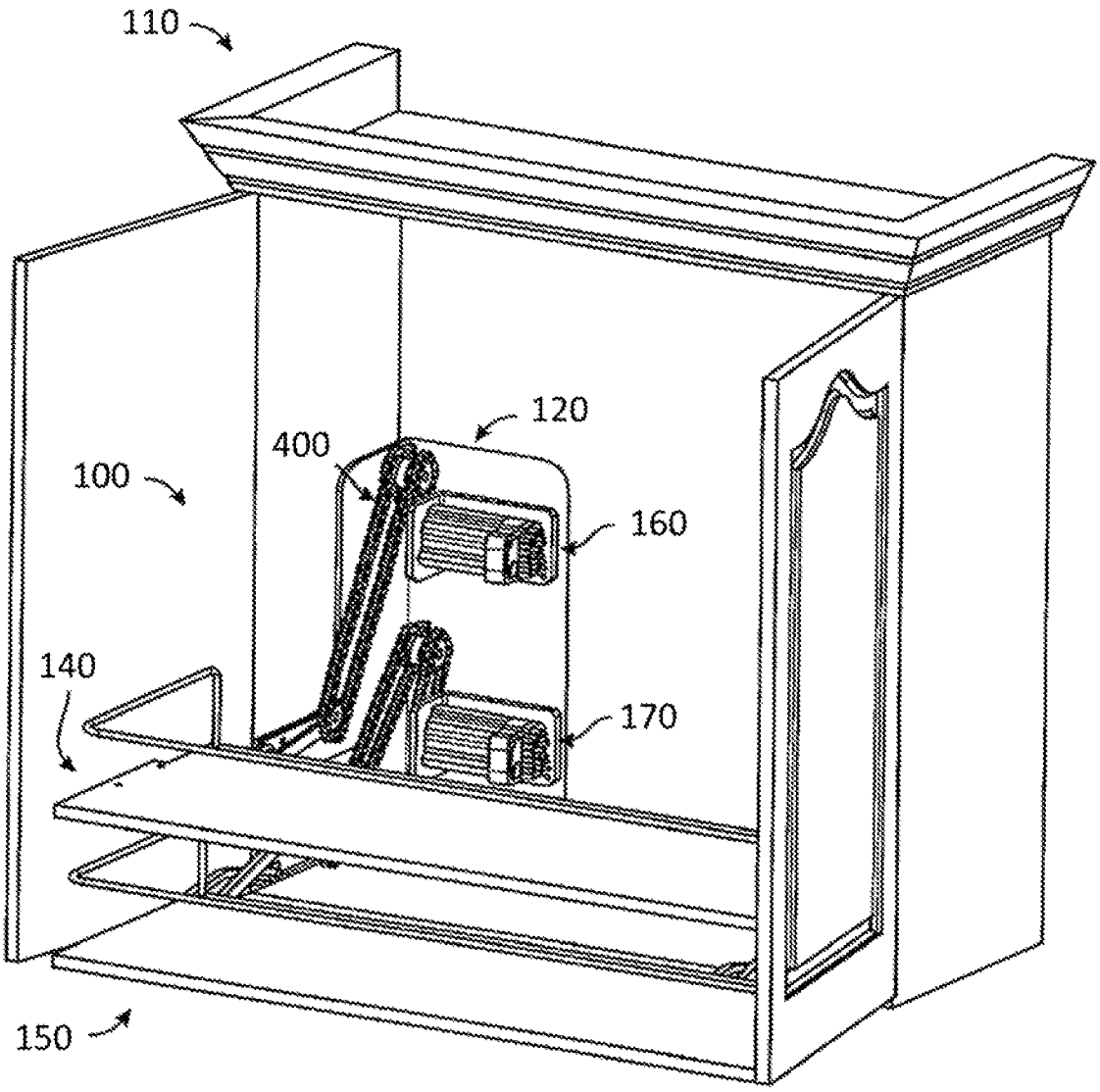
FIG. 2 is a perspective view of the motorized shelf assembly of FIG. 1 in a cabinet with both upper and lower shelf assemblies shown in the "down" or "deployed" position.
Figure 3:
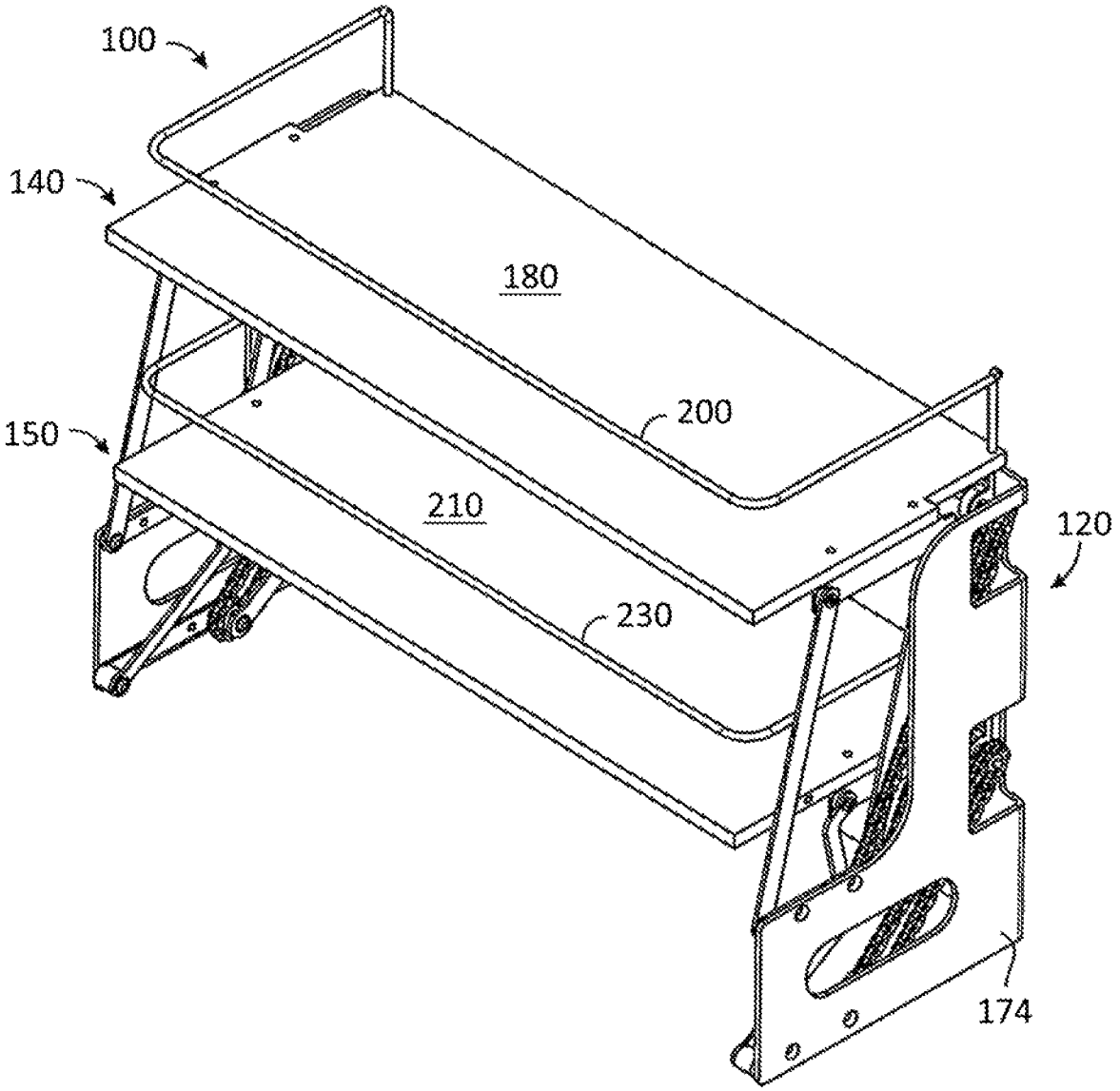
FIG. 3 is a perspective view of the motorized shelf assembly of FIGS. 1 and 2 removed from the cabinet and with both upper and lower shelf assemblies shown in the "up" or retracted" position.
Figure 4:
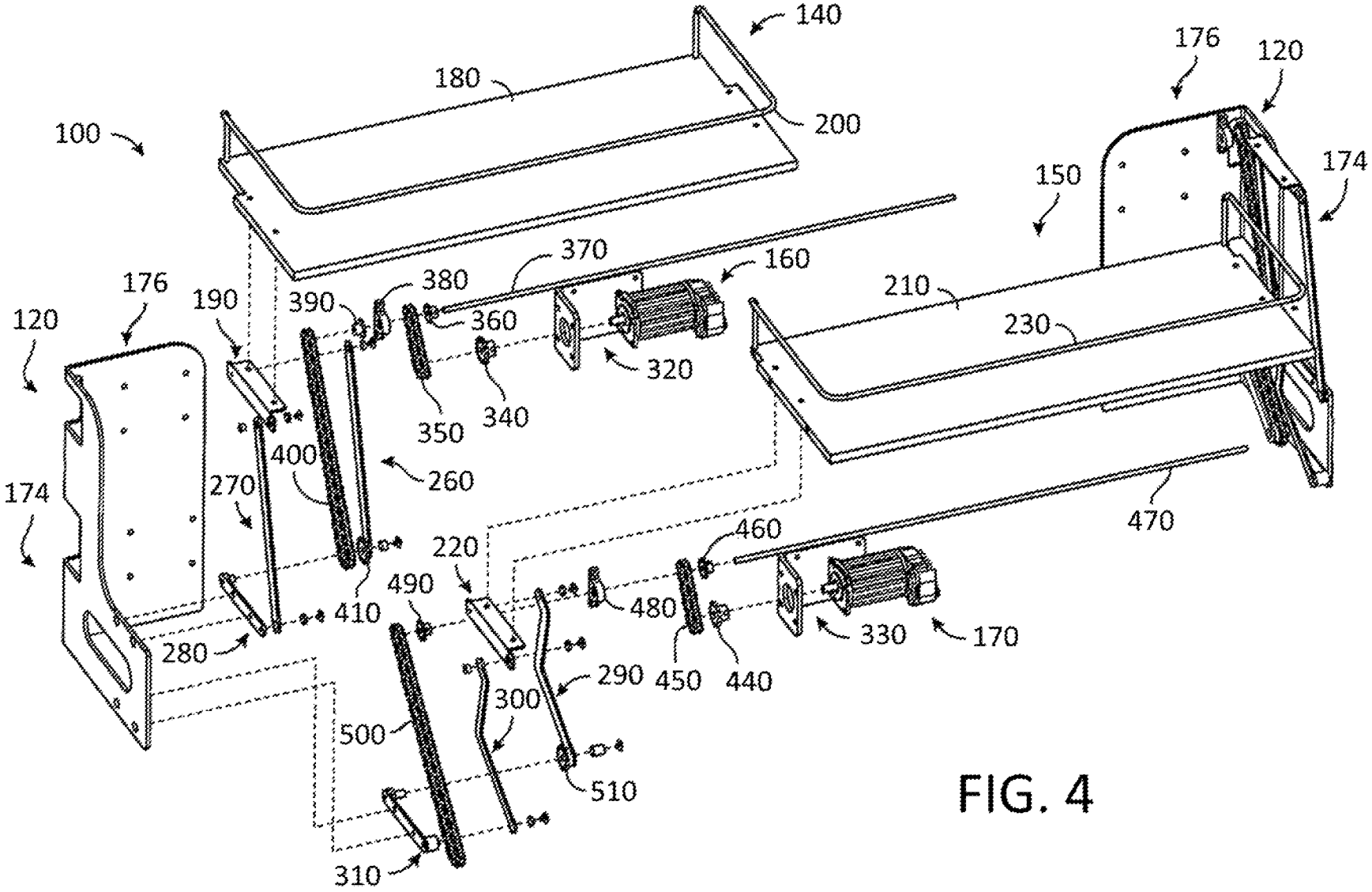
FIG. 4 is an exploded perspective view of the motorized shelf assembly of FIGS. 1-3.
Figure 5:
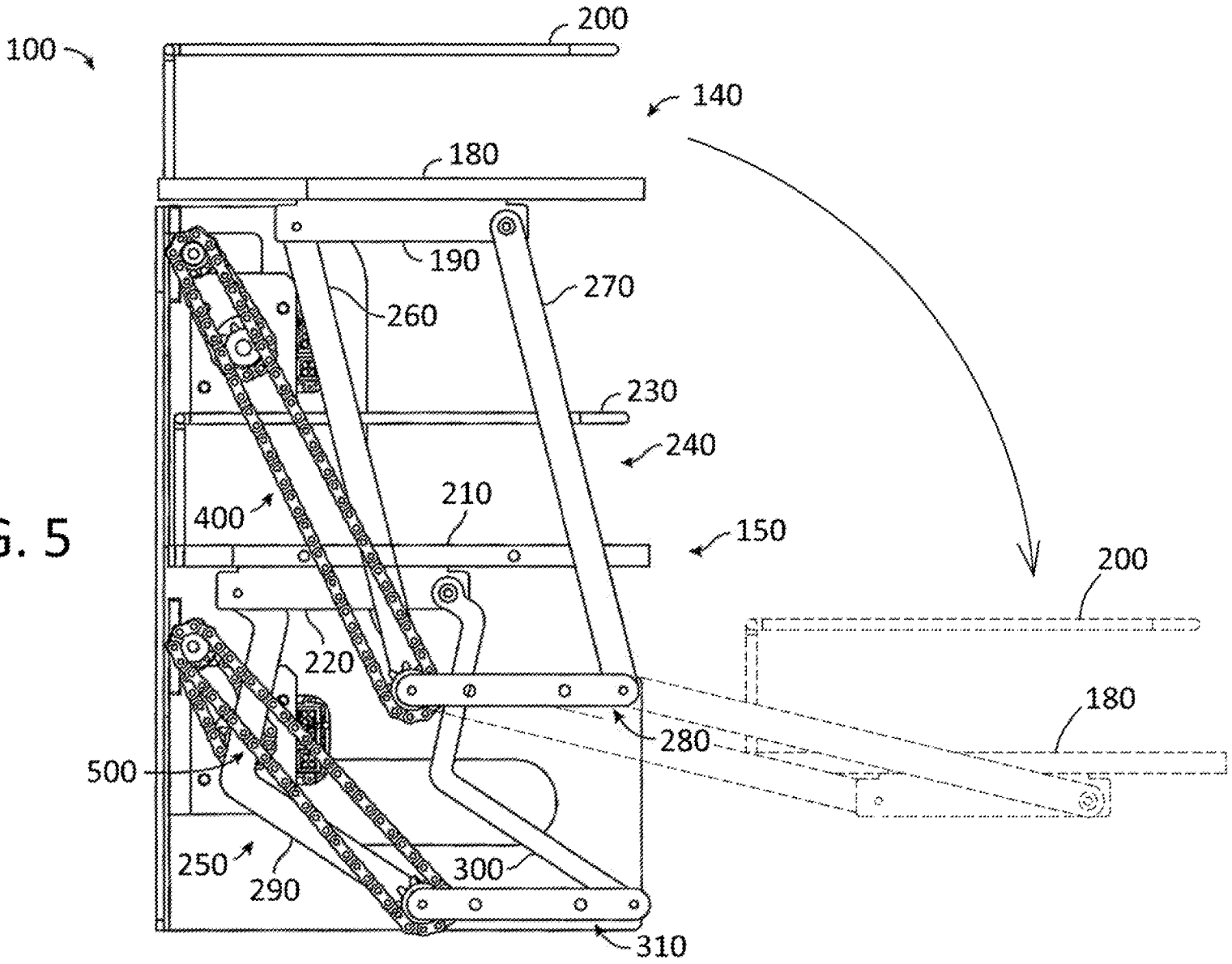
FIG. 5 is an end view of the motorized shelf assembly of FIGS. 1-4 with a mounting plate removed for clarity and with both upper and lower shelf assemblies shown in the "up" or "retracted" position.
Figure 6:
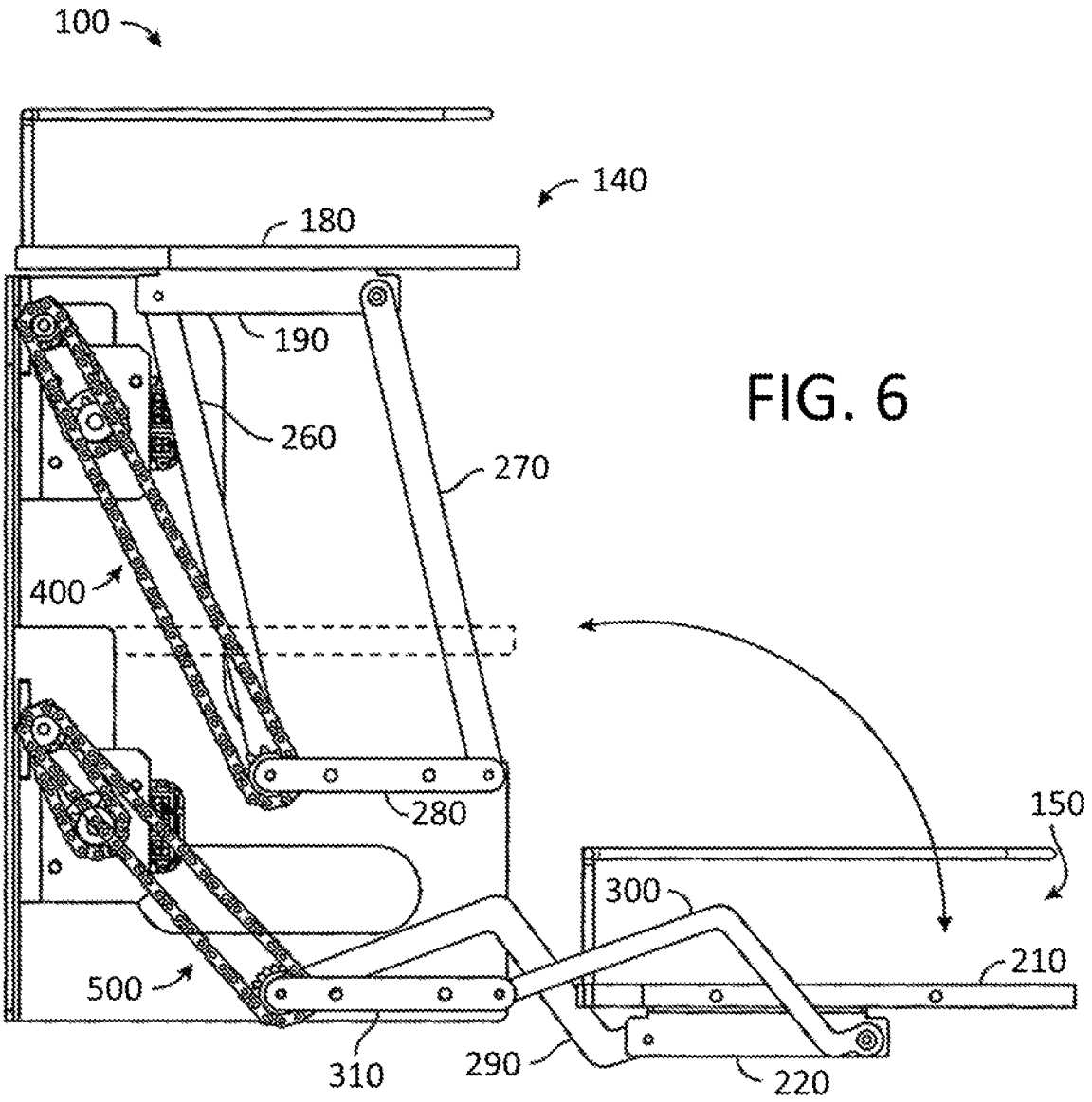
FIG. 6 is an end view of the motorized shelf assembly, similar to FIG. 5, and shows a lower shelf assembly in the "down" or "deployed" position.

With reference to FIGS. 1-6, an embodiment of motorized shelf assembly 100 for a cabinet 110 will be described. The motorized shelf assembly 100 includes a pair of mounting plates 120 along opposite ends 130 of the motorized shelf assembly 100 for mounting the motorized shelf assembly 100 within the cabinet 110. An upper shelf assembly 140 and a lower shelf assembly 150 are operably coupled to the mounting plates 120. The upper shelf assembly 140 and a lower shelf assembly 150 are driven by respective upper shelf and lower shelf motors 160, 170 for moving the upper shelf assembly 140 and the lower shelf assembly 150 between an "up" or "retracted" position and a "down" or "deployed" position.

The mounting plates 120 include an L-shaped side plate member 174 and a perpendicularly disposed rectangular rear plate member 176. The side plate member 174 and the rear plate member 176 include holes therein for mounting the mounting plates to inner sides and rear of the cabinet 110.

The upper shelf assembly 140 includes a substantially rectangular upper shelf 180 with holes along opposite sides for mounting the upper shelf 180 to mounting brackets 190. A substantially U-shaped decorative rail 200 is attached to the upper shelf 180 near opposite inner corners and is disposed a spaced height above the upper shelf 180 adjacent to two side edges and an outer edge of the upper shelf 180.

Similarly, the lower shelf assembly 150 includes a substantially rectangular lower shelf 210 with holes along opposite sides for mounting the lower shelf 210 to mounting brackets 220. A substantially U-shaped decorative rail 230 is attached to the lower shelf 210 near opposite inner comers and is disposed a spaced height above the lower shelf 210 adjacent to two side edges and an outer edge of the lower shelf 210.

The upper shelf assembly 140 and the lower shelf assembly 150 are operably coupled to the mounting plates 120 and the respective motors 160,170 via upper and lower pivoting support assemblies 240, 250.

The upper pivoting support assembly 240 includes a pair of first and second parallel straight upper shelf pivot arms 260, 270 that are pivotally connected at upper ends to the mounting brackets 190 via fasteners and are pivotally connected at lower ends to upper shelf mounting plates 280 via fasteners. The upper shelf mounting plates 280 are attached to inner surfaces of L-shaped side plate member 174 of the mounting plates 120 via fasteners.

The lower pivoting support assembly 250 includes a pair of first and second spaced V-shaped pivot arms 290, 300 that are pivotally connected at upper ends to the mounting brackets 220 via fasteners and are pivotally connected at lower ends to lower shelf mounting plates 310 via fasteners. The lower shelf mounting plates 310 are attached to inner surfaces of L-shaped side plate member 174 of the mounting plates 120 via fasteners below the upper shelf mounting plates 280. The first/second lower pivot arms 290, 300 are V-shaped or dog-legged shaped on the lower shelf to avoid hitting the lower or bottom shelf of the cabinet 110.

The upper shelf motor 160 is mounted to an inner surface of the rectangular rear plate member 176 of left mounting plate 120 via an upper motor mounting bracket 320 and fasteners.

The lower shelf motor 170 is mounted to an inner surface of the rectangular rear plate member 176 of left mounting plate 120 via lower motor mounting bracket 330 and fasteners below the upper motor mounting bracket 320.

The upper shelf motor 160 and the lower shelf motor 170 control pivoting movement of the upper shelf assembly 140 and the lower shelf assembly 150. The upper shelf motor 160 is operably coupled to the upper shelf assembly 140 for controlling pivoting movement of the upper shelf assembly 140 through chain sprocket 340, roller chain 350, sprocket 360, main shaft 370, base mounted bearing 380, sprocket 390, roller chain 400, and sprocket 410 of first upper shelf pivot arm 260. Appropriate fasteners connect relevant components together.

The lower shelf motor 170 is operably coupled to the lower shelf assembly 150 for controlling pivoting movement of the lower shelf assembly 150 through chain sprocket 440, roller chain 450, sprocket 460, main shaft 470, base mounted bearing 480, sprocket 490, roller chain 500, and sprocket 510 of first lower shelf pivot arm 290. Appropriate fasteners connect relevant components together.

Figure 7:
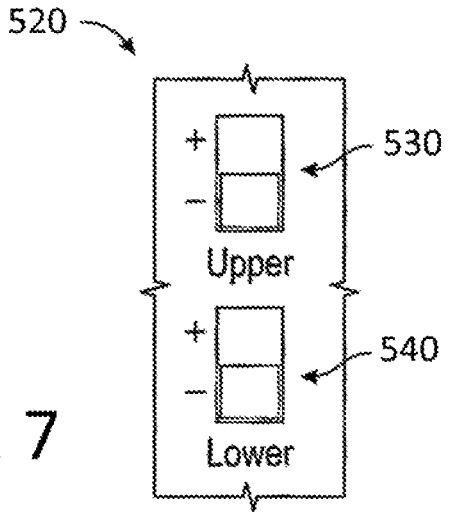
FIG. 7 is a front elevational view of an embodiment of a remote control for the motorized shelf assembly.

As shown in FIG. 7, the motorized shelf assembly 100 may include one or more controller(s) 520 to control operation of the upper shelf motor 160 and the lower shelf motor 170 for lowering and raising the upper shelf assembly 140 and the lower shelf assembly 150. The motors 160, 170 may be individually controlled and/or controlled in unison by the one or more controller(s) 520. The one or more controller(s) 520 may be directly electrically coupled and/or wirelessly coupled to the upper shelf motor 160 and the lower shelf motor 170 for controlling operation of the motors 160, 170. The controller 520 may include an upper shelf control switch 530 for lowering and raising the upper shelf assembly 140 and a lower shelf control switch 540 for lowering and raising the lower shelf assembly 150. If the one or more controller(s) 520 is/are directly electrically coupled to the motors 160, 170, the controller(s) 520 may be disposed on or adjacent to the cabinet 110. If the one or more controller (s) 520 is/are wireless coupled to the motors 160, 170, the controller(s) 520 may be one or more remote controls that include appropriate electrical hardware and/or software including transmitter(s)/transceiver(s) that wireless communicate with receiver(s)/transceiver(s) in appropriate electrical hardware and/or software in or adjacent to the cabinet 110 for controlling the motors 160, 170 wirelessly.

Although the motorized shelf assembly 100 is shown as having two shelf assemblies 140, 150, in alternative embodiments, the motorized shelf assembly 100 includes other numbers of shelf assemblies (e.g., 1,3,4, 5, etc.). Similarly, in alternative embodiments, the motorized shelf assembly 100 may have other numbers of motors (e.g., 1, 3, 4, 5, etc.) to control one or more shelf assemblies. For example, but not by way of limitation, a single motor may be used to control multiple shelf assemblies individually through one or more coupling/decoupling mechanisms, or in unison.

With reference to FIGS. 1, 2, 5 and 6, the motorized shelf assembly 100 will now be described in use. The shelves and shelf supports of an existing cabinet 110 are removed and replaced with the motorized shelf assembly 100. The motorized shelf assembly 100 is attached to the inner rear wall and inner side walls of the cabinet 110 through the rear plate members 176 and side plate members 174 of the mounting plates 120. The motors 160, 170 are individually controlled or controlled in unison by the one or more controller{s) 520 to control operation of the upper shelf motor 160 and the lower shelf motor 170 for lowering and raising the upper shelf assembly 140 and the lower shelf assembly 150.

To lower the lower shelf assembly 150, the doors of the cabinet 110 are opened and the lower shelf motor 170 is controlled to rotate, causing roller chain 450 to rotate. This causes sprocket 460 on main shaft 470 to rotate, causing roller chain 500 to rotate. Rotating roller chain 500 causes sprocket 510 to rotate, which causes first lower shelf pivot arm 290 to pivot downwardly. Because second lower shelf pivot arm 300 is intercoupled for movement with first lower shelf pivot arm 290, downward pivotal movement of first lower shelf pivot arm 290 causes corresponding downward pivotal movement of second lower shelf pivot arm 300, causing the lower shelf assembly 150 to move downward to the down or deployed position shown in FIG. 6.

To raise the lower shelf assembly 150, the motor 170 is controlled to rotate in an opposite direction, causing roller chain 450 to rotate. This causes sprocket 460 on main shaft 470 to rotate, causing roller chain 500 to rotate. Rotating roller chain 500 causes sprocket 510 to rotate, which causes first lower shelf pivot arm 290 to pivot upwardly. Because second lower shelf pivot arm 300 is intercoupled for movement with first lower shelf pivot arm 290, upward pivotal movement of first lower shelf pivot arm 290 causes corresponding upward pivotal movement of second lower shelf pivot arm 300, causing the lower shelf assembly 150 to move upwardly to the upward or retracted position shown in FIG. 5.

To lower the upper shelf assembly 140, the doors of the cabinet 110 are opened and the upper shelf motor 160 is controlled to rotate, causing roller chain 350 to rotate. This causes sprocket 360 on main shaft 470 to rotate, causing roller chain 400 to rotate. Rotating roller chain 400 causes sprocket 410 to rotate, which causes first upper shelf pivot arm 260 to pivot downwardly. Because second upper shelf pivot arm 270 is intercoupled for movement with first upper shelf pivot arm 260, downward pivotal movement of first upper shelf pivot arm 260 causes corresponding downward pivotal movement of second upper shelf pivot arm 270, causing the upper shelf assembly 140 to move downward to the down or deployed position shown in FIG. 2.

To raise the upper shelf assembly 140, the upper shelf motor 160 is controlled to rotate in an opposite direction, causing roller chain 350 to rotate. This causes sprocket 360 on main shaft 470 to rotate, causing roller chain 400 to rotate. Rotating roller chain 400 causes sprocket 410 to rotate, which causes first upper shelf pivot arm 260 to pivot upward. Because second upper shelf pivot arm 270 is intercoupled for movement with first upper shelf pivot arm 260, upward pivotal movement of first upper shelf pivot arm 260 causes corresponding upward pivotal movement of second upper shelf pivot arm 270, causing the upper shelf assembly 140 to move upward to the upward or retracted position shown in FIGS. 2 and 5.

As mentioned previously, the motorized shelf assembly 100 is controlled to lower one or both of the upper shelf assembly 140 and the lower shelf assembly 150. In the lowered or deployed position, a user can easily remove or add glasses, dishes, or other articles from/to the upper shelf assembly 140 and/or the lower shelf assembly 150. When the user is done removing/adding glasses, dishes, or other articles, the motorized shelf assembly 100 is controlled to raise one or both of the upper shelf assembly 140 and the lower shelf assembly 150, and the doors of the cabinet 110 are closed.

Advantages of the motorized shelf assembly 100 compared to a manual shelf assembly that manually pulls out from a cabinet include one or more of, but not limited to, the following:

Manual Shelf Assembly:

1. A manual pull and push assembly/system can be adequate at waist height or below such typical slide in/out for kitchen pots and pans under the sink. However, at or above waist height, human physical factors take over regardless if the unit is used in a kitchen or other similar application.

a. Physical factors include a person's stature, physical strength, weight of the person and motor skills such as reach or range of motion and balance.

b. In addition, for an overhead manual shelf to operate, a hand-held pole or other extension devise may be required to move the unit up or down. This is another negative situation that creates physical concerns, including an additional balancing maneuver.

2. A manual system is also limited by a maximum weight that each shelf can accommodate. It is restricted to the length of the shelf, typically 32"-44" and the height of or number of "shelves" is finite. Typically, manual shelves would be limited to only two shelves when most standard shelves are three or more.

3. Functional adaptation is also an issue. Attempting to add or adapt a motor to an existing manual shelf is basically not feasible. The entire manual shelf configuration and mechanical systems must be completely redesigned and almost nothing of the original manual shelf design is salvageable.

Motorized Shelf Assembly:

1. The motorized shelf assembly/system does not require any special physical ability. Push of a button, similar to a TV remote, will allow the shelves to move up and down.

2. A motorized unit may not be as constrained by weight of the contents within the individual shelf as with a manual shelf. For the embodiment shown herein, the shelves are being designed to accommodate about 30 lbs.

3. The physical length of the shelves and height are not restricted as with a manual design.

Applications:

Although the motorized shelf assembly 100 has been described in conjunction with a kitchen cabinet 110, the various applications of the motorized shelf assembly 100 are almost limitless. The mechanical movements/chains and motor of the motorized shelves are not very visible and are esthetically attractive. The units are adaptable for a number of applications that include residential homes and multifamily use to a number of commercial uses.

With almost limitless height and number of shelves, any space sensitive facilities are considered, such as individual residential homes, apartment buildings, senior citizen, assisted living, congregate care and hospital facilities (supplies, materials and more). These units are excellent for those persons who may have some physical challenges as well as those facilities that have limited space and every useable inch of space can be used.

For commercial use it is well suited for those businesses that are in continuous use, such as stocking and restocking without the use of forklifts. They can include electronic equipment/parts, computer software/hardware, wholesale/retail automotive parts supply, food services both wholesale/retail and other operations that have small to medium inventory with space limitations. As a special note, due to the ability to extend the height of the shelves to the ceiling can help decrease the operations cost as less "storage facilities" or warehouse space is not need because all interior space can be utilized.

Moreover, as noted previously, the shelves are excellent for those who may have some physical impairment. A special advantage of the motorized unit is also possible reduced OSHA concerns and insurance claims due to trip and fall hazards associated with any manual system or use of ladders, step stools and more.

Figure 8:
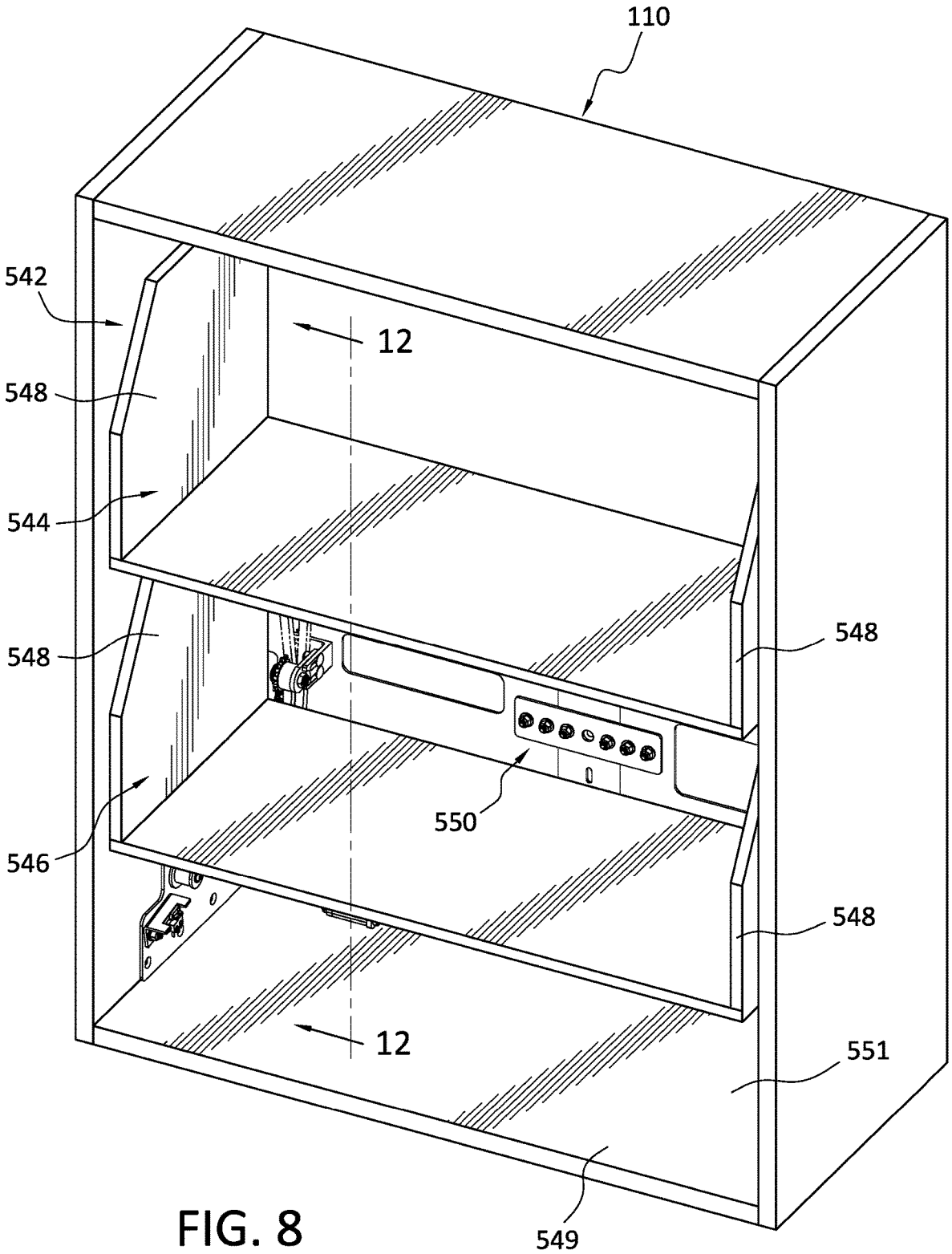
FIG. 8 is a perspective view of another embodiment of a motorized shelf assembly embodying the present invention.
Figure 9:
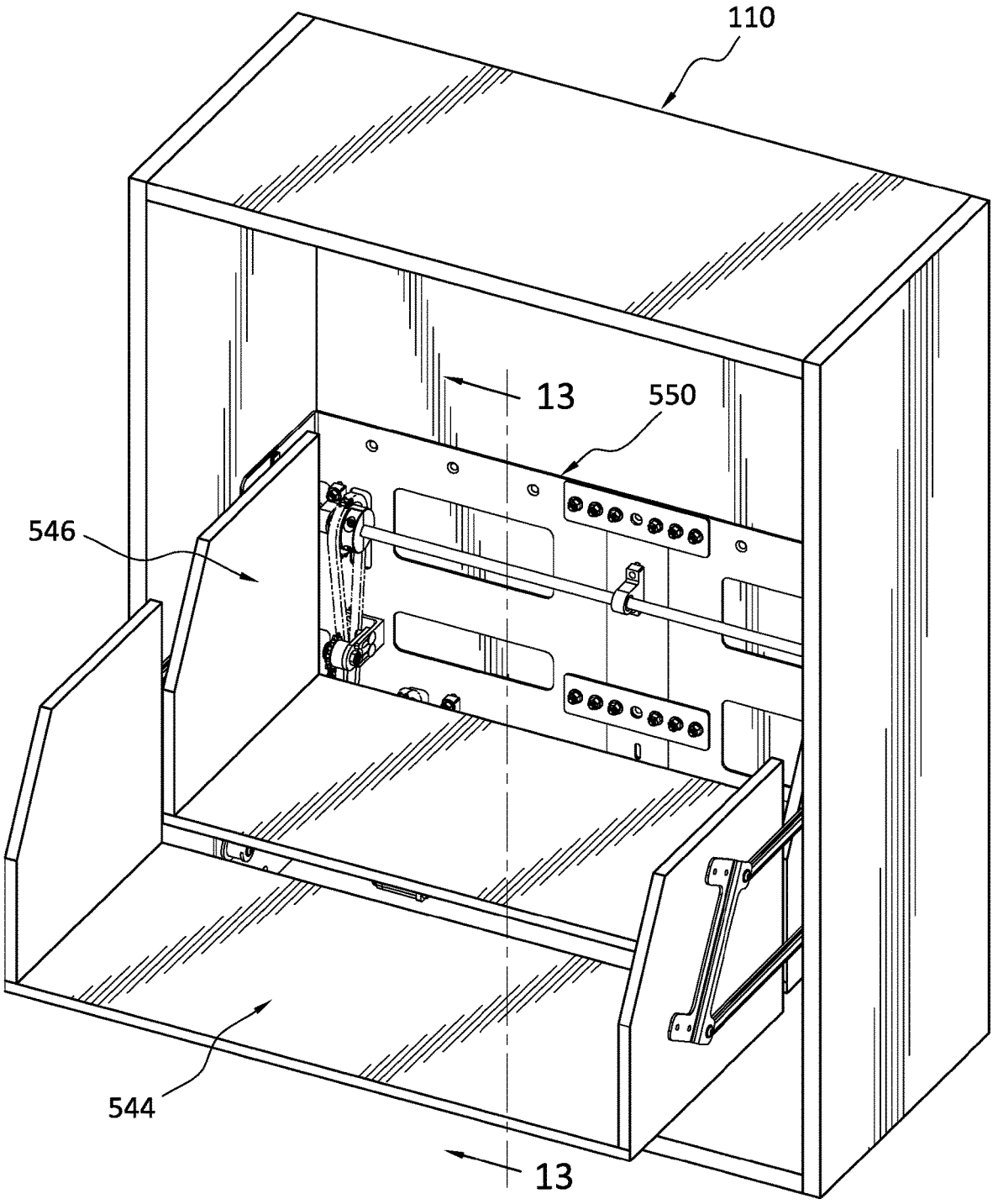
FIG. 9 is a perspective view of the shelf assembly showing an upper shelf in the down or deployed position.
Figure 10:
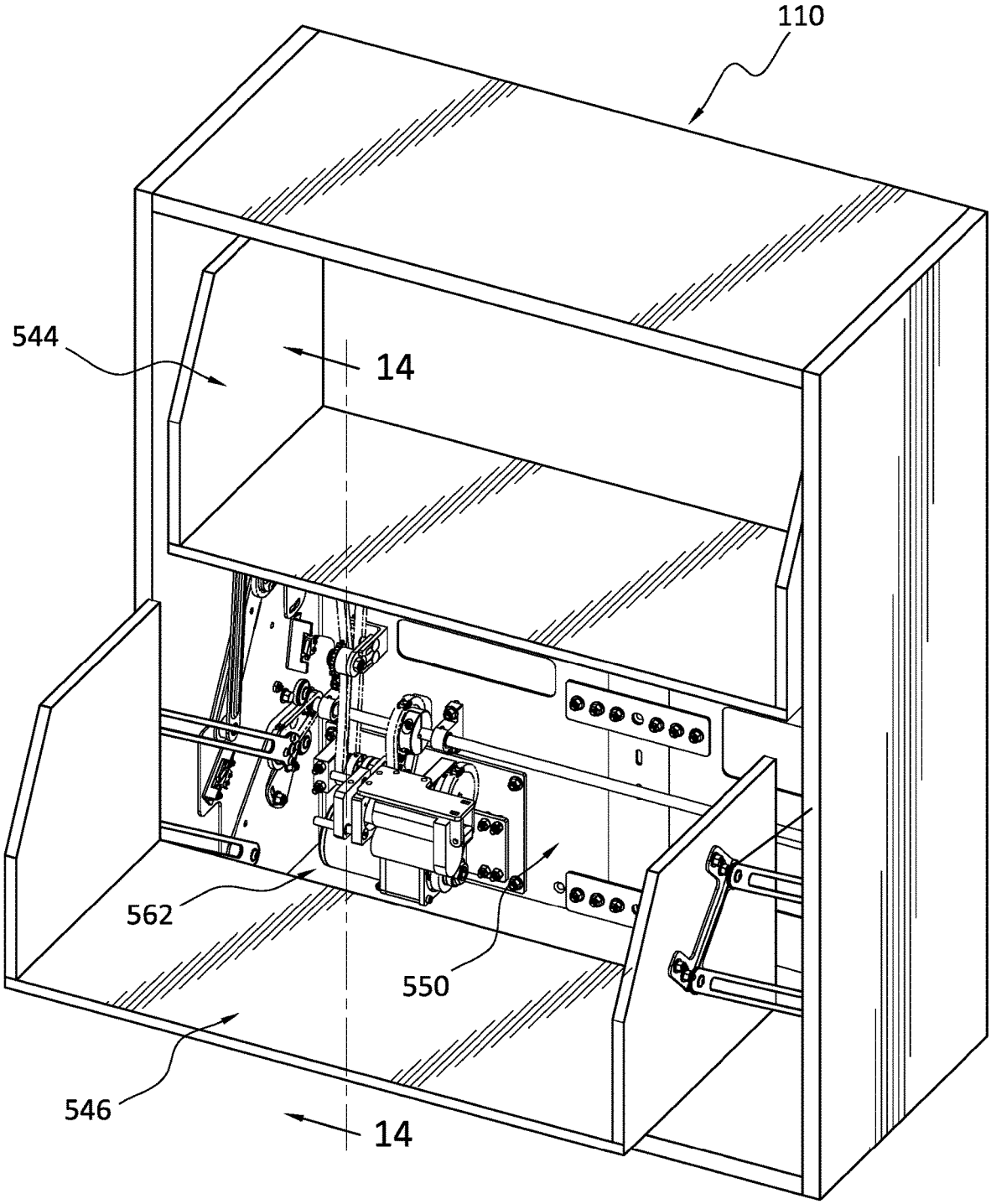
FIG. 10 is a perspective view of the shelf assembly showing a lower shelf in the down or deployed position.

Referring to FIGS. 8, 9 and 10 another embodiment of a motorized shelf assembly 542 inside the cabinet 110 is disclosed. The assembly 542 includes an upper shelf 544 and a lower shelf 546. Each of the shelves 544 and 546 includes side walls 548 disposed at respective ends of the shelves. Each of the shelves 544 and 546 is movable from a retracted position to a deployed position, which is outwardly and below the respective retracted positions. The shelves 544 and 546 are operably attached to a U-shaped frame 550, which is operably attached to the cabinet 100. A fixed, non-movable shelf 549 is disposed below the shelf 546. The fixed shelf 549 is typically at a height easily within reach by a user. Space 551 below the lower shelf 546 and above the fixed shelf 549 advantageously provides space for the motor drive disposed below the lower shelf 546.

Figure 11:
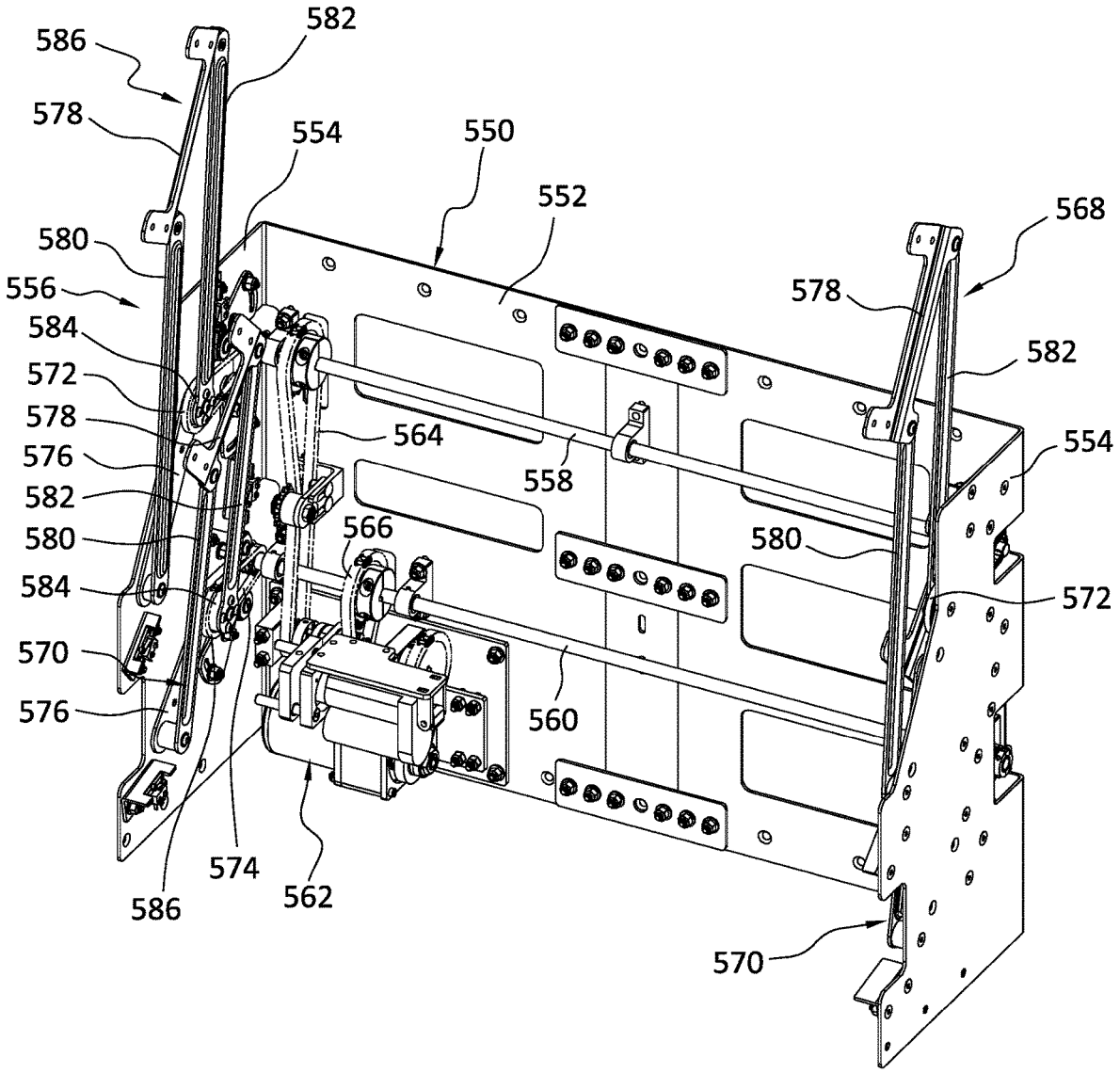
FIG. 11 is a perspective view of the shelf assembly with the shelves removed to show the operating mechanism for lowering or deploying the shelves.

Referring to FIG. 11, the frame 550 has a base 522 and sides 554. The frame 550 carries a motorized mechanism 556 for actuating the shelves between the retracted and deployed positions. The mechanism 556 includes an upper shaft 558 and a lower shaft 560 extending between the sides 554. A motor drive 562 selectively drives the shafts 558 and 560. A chain 564 is operably connected to the motor drive 562 to drive the upper shaft 558. A chain 566 is operably connected to the motor drive 562 to drive the lower shaft 560. Upper parallelogram linkages 568 are operably attached to the respective ends of the upper shelf 544 and the sides 554. Lower parallelogram linkages 570 are operably attached to the respective ends of the lower shelf 546 and the sides 554. Chains 572 are operably connected to the upper parallelogram linkages 568 and the upper shaft 558 to drive the upper parallelogram linkages 568 between the retracted position and the deployed position of the upper shelf 544. Chains 574 are operably connected to the lower parallelogram linkages 570 and the lower shaft 560 to drive the lower parallelogram linkages 570 between the retracted position and the deployed position of the lower shelf 546.

Each of the upper parallelogram linkages 568 and and the lower parallelogram linkages 570 includes a mounting bracket 576 for attachment to the side 554 of the frame 550, a mounting bracket 578 for attachment to the respective shelves 544 and 546, and pivot arms 580 and 582 pivotably attached to the ends of the respective mounting brackets 576 and 578. Sprockets 584 and 586 are fixedly attached to the respective pivot arms 582 and are operably driven by the respective chains 572 and 574. Rotation of the sprockets 584 and 586 is effective to pivot the respective arms 582, thereby driving the upper shelf 554 and the lower shelf 546, respectively, between the retracted positions and the deployed positions.

Figure 12:
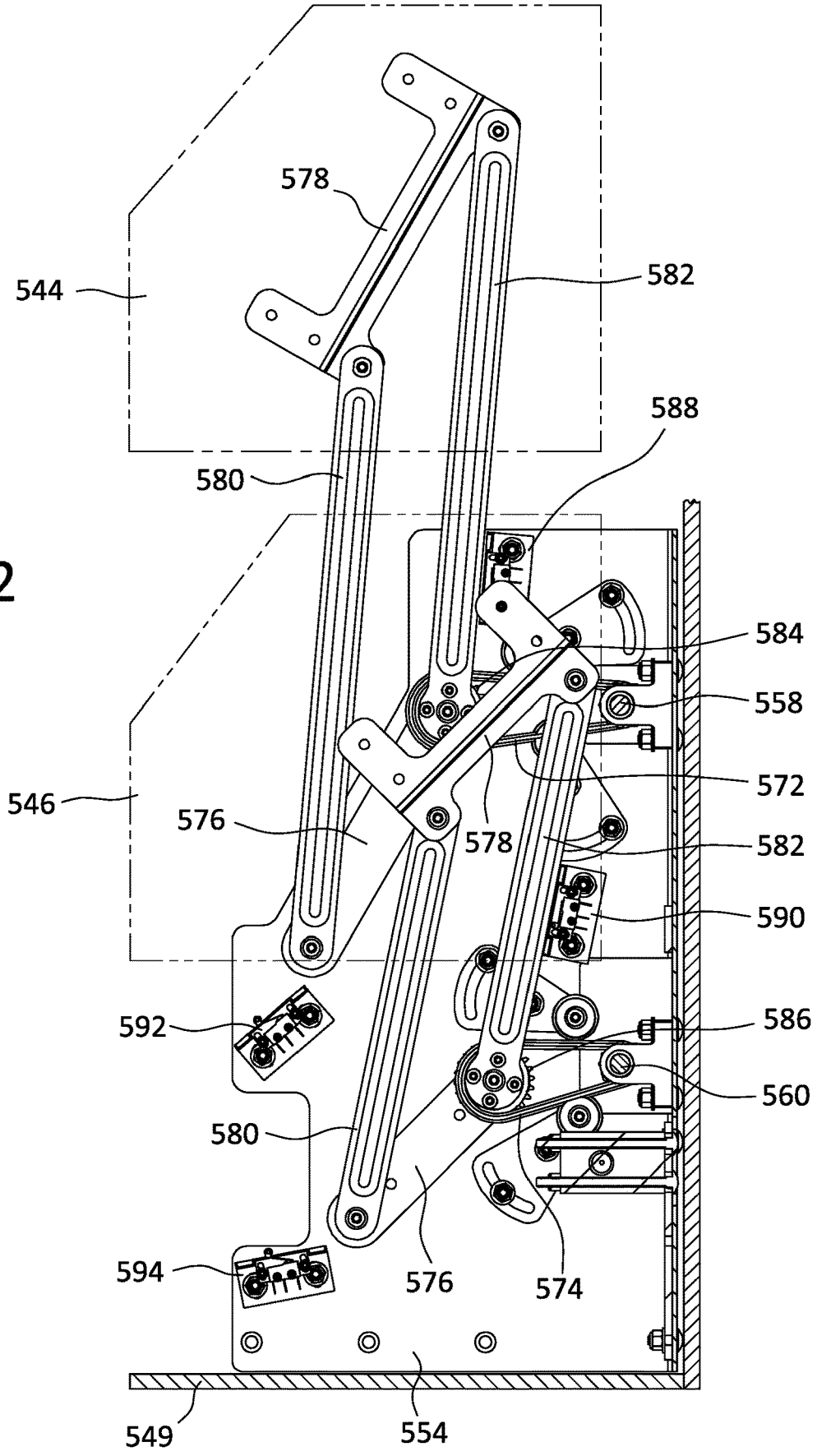
FIG. 12 is a cross-sectional view taken along line 12-12 in FIG. 8.

Referring to FIG. 12, the shelves 544 and 546 are shown in phantom lines in their retracted positions. It should be understood that all the items shown in FIG. 12 are also present and mirrored on the right side of the frame 550, some of which are partly visible in FIG. 11. Limit switches 588 and 590 are effective to stop the motor drive 562 when activated by the respective pivot arms 582 in the retracted positions. Limit switches 592 and 594 are effective to stop the motor drive 562 when activated by the respective pivot arms 580 in the deployed positions.

Figure 13:
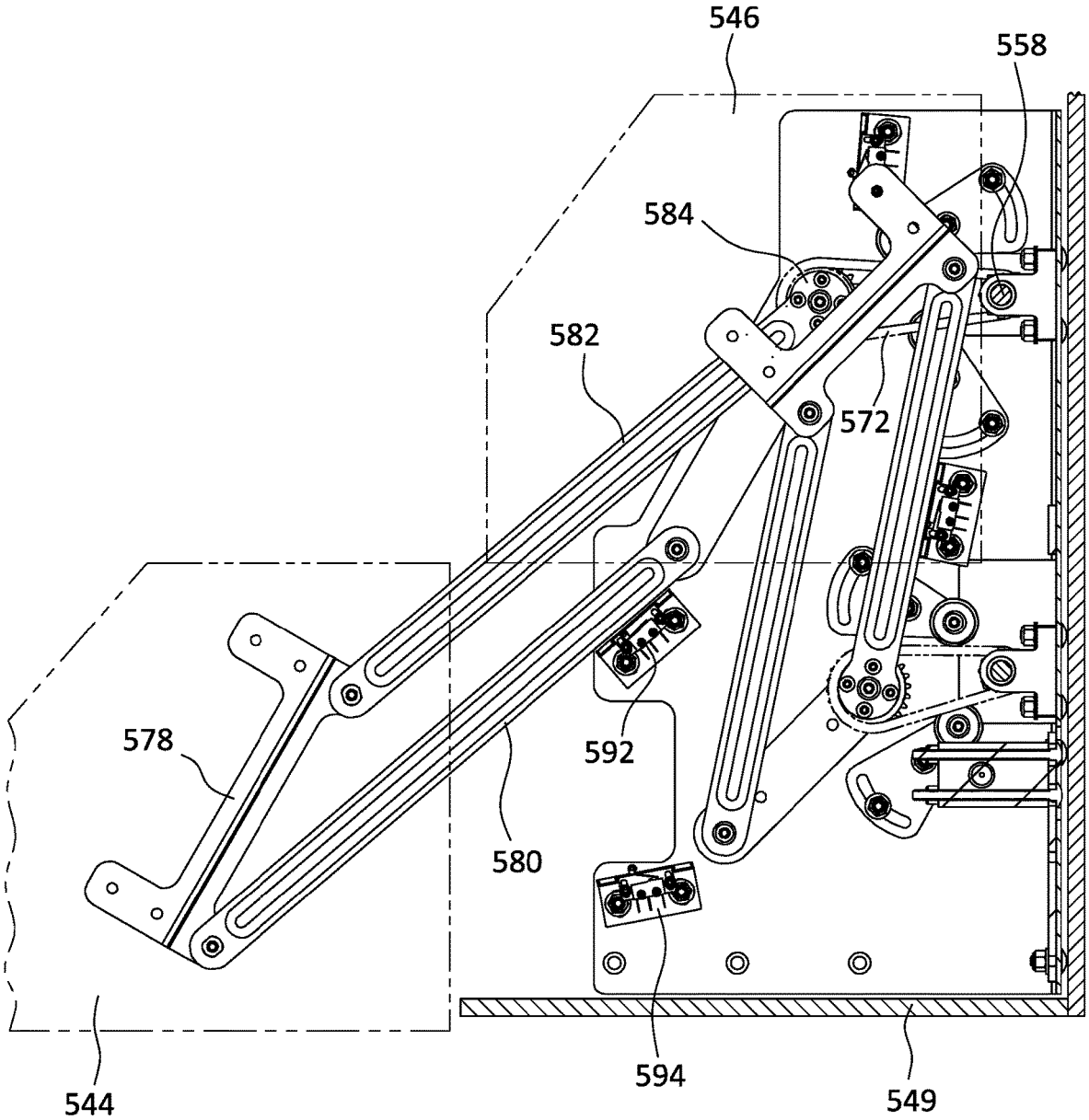
FIG. 13 is a cross-sectional view taken along line 13-13 in FIG. 9.

Referring to FIG. 13, rotation of the upper shaft 558 counterclockwise lowers the upper shelf 554 to its deployed position via the chain 572 driving the sprocket 584, which is fixedly attached to the pivot arm 582. The limit switch 592 stops the motor drive 562 when activated by the pivot arm 580. Rotation of the shaft 558 in the clockwise direction is effective to bring the shelf 544 back to its retracted position. The upper shelf 544 in its lowest position as determined by the limit switch 592 is substantially the same level as the fixed shelf 549.

Figure 14:
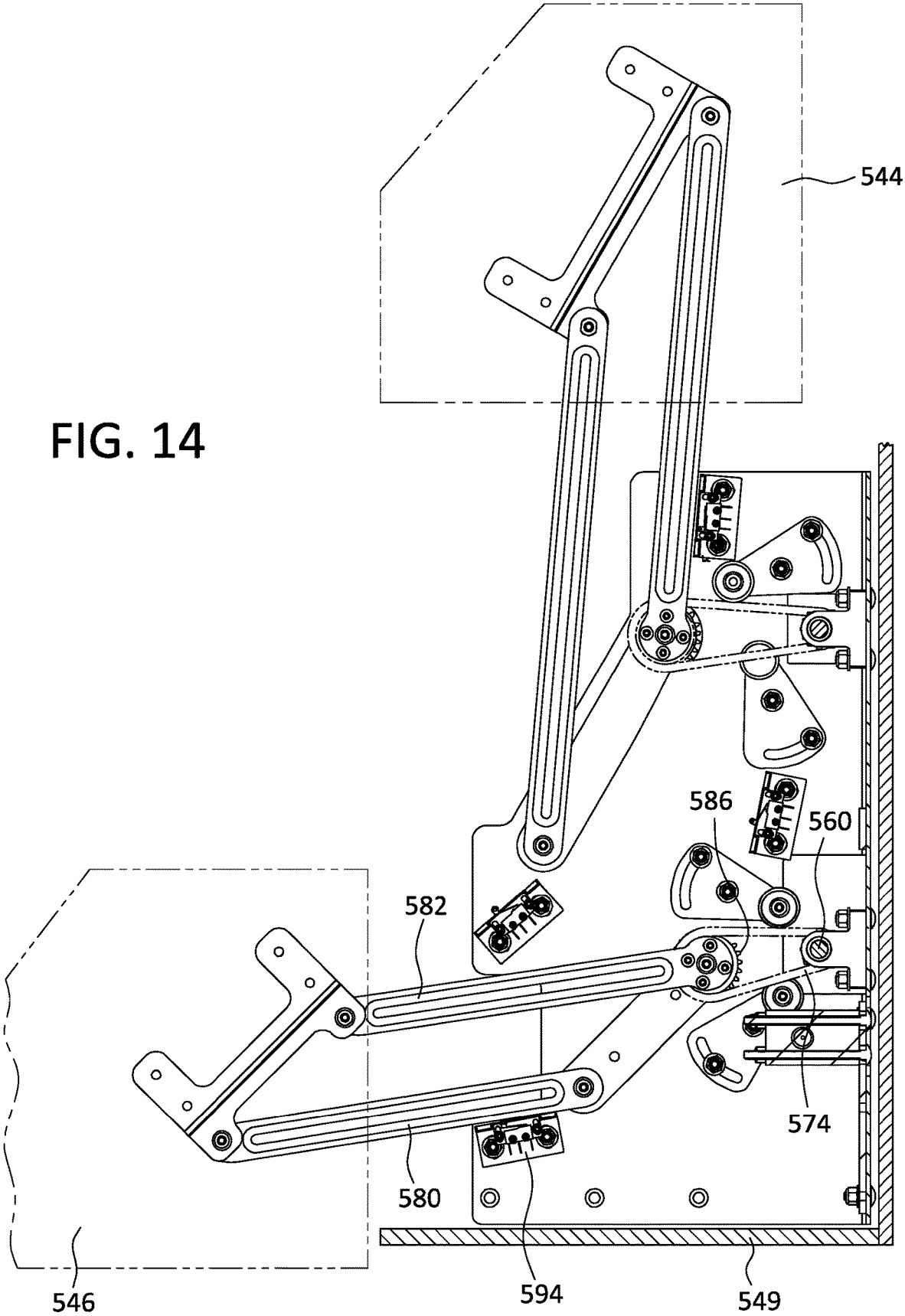
FIG. 14 is a cross-sectional view taken along line 14-14 in FIG. 10.

Referring to FIG. 14, rotation of the lower shaft 560 counterclockwise lowers the lower shelf 546 to its deployed position via the chain 574 driving the sprocket 586, which is fixedly attached to the pivot arm 582. The limit switch 594 stops the motor drive 562 when activated by the pivot arm 580. Rotation of the shaft 560 in the clockwise direction is effective to bring the shelf 546 back to its retracted position. The lower shelf 546 in its lowest position as determined by the limit switch 594 is substantially the same level as the fixed shelf 549. The arc of travel of the lower shelf 546 during deployment advantageously stays clear of the space 551 so that any contents on the fixed shelf 549 are not disturbed.

Figure 15:
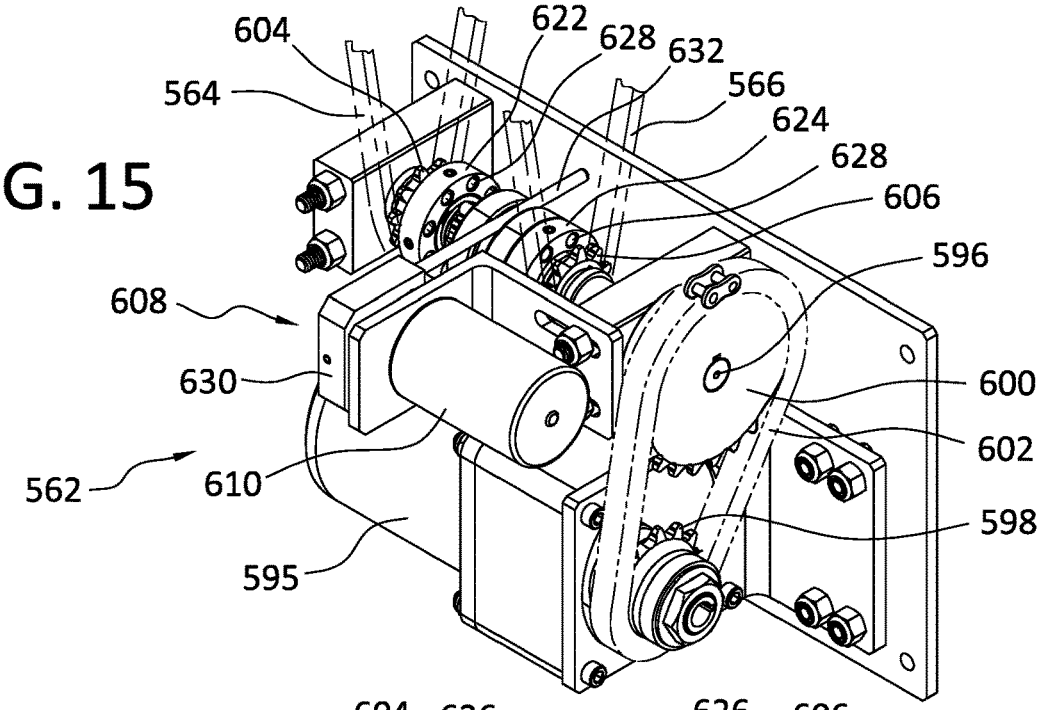
FIG. 15 is a perspective view of a motor drive embodying the present invention.
Figure 16:
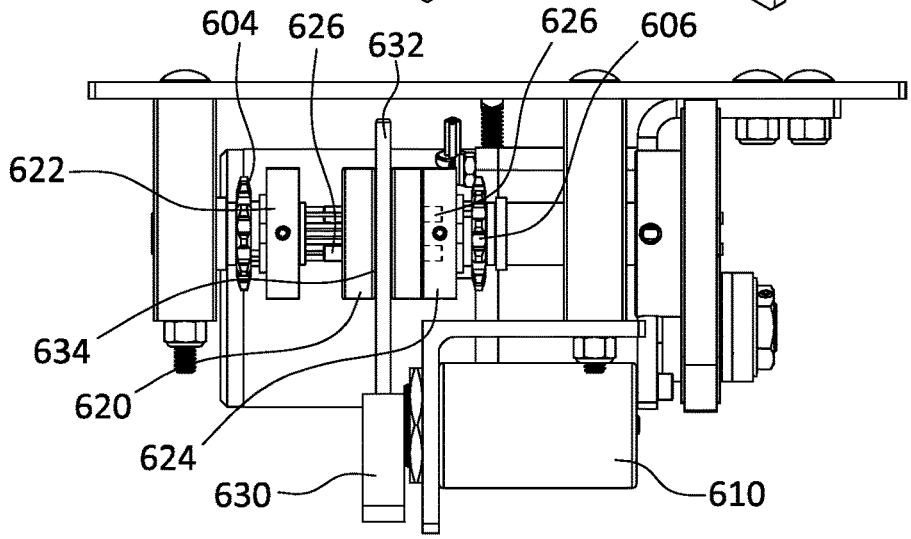
FIG. 16 is a top view of FIG. 15 showing the motor drive engaged to drive the lower shelf.
Figure 17:
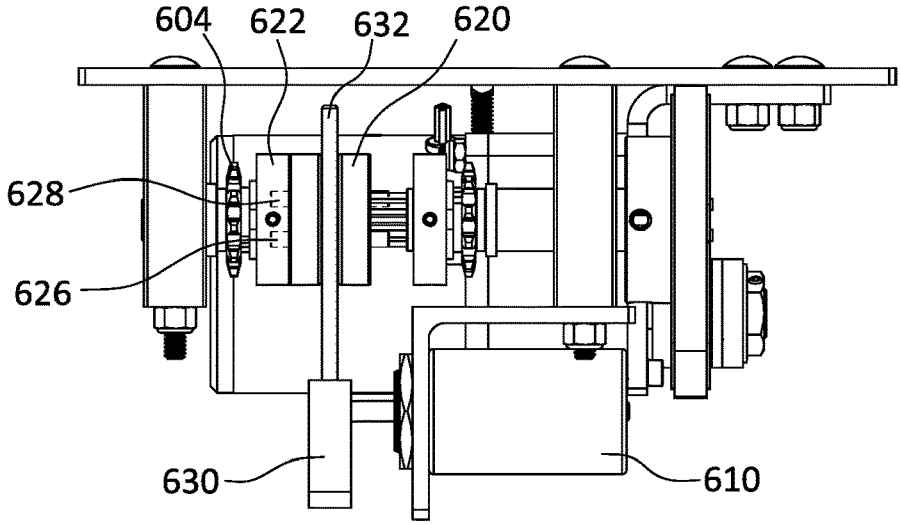
FIG. 17 is a top view of FIG. 15 showing the motor drive engaged to drive the upper shelf.

Referring to FIGS. 15, 16 and 17, the motor drive 562 includes a motor 595 that drives a spline shaft 596 via a sprocket 598 driving another sprocket 600 connected by a chain 602. The spline shaft 596 drives either sprocket 604 or sprocket 606. A clutch 608 transfer the power of the spline shaft 596 to either the sprocket 604 or 606. The clutch includes a solenoid 610 that moves a spline bushing 620 to engage either cog wheel 622 or 624. The spline bushing 620 is driven by the spline shaft 596 and includes axial dowels 626, which are received in respective axial holes 628 in the respective cog wheels 622 and 624. The cog wheels 622 and 624 are fixedly attached to the respective sprockets 604 and 606. The solenoid 610 is operably connected to the spline bushing 620 via a block 630 carrying rods 632 captured in an annular groove 634 in the spline bushing 620.

When the solenoid 610 is the retracted position as shown in FIG. 16, the dowels 626 are inside the respective holes 628, thereby locking the spline bushing 620 with the cog wheel 624, which is fixedly attached to the sprocket 606. The rotation of the spline bushing 620 is thus transferred to the sprocket 606, which is connected to the chain 566, driving the lower shaft 560.

When the solenoid 610 is the extended position as shown in FIG. 17, the dowels 626 are inside the respective holes 628, thereby locking the spline bushing 620 with the cog wheel 622, which is fixedly attached to the sprocket 604. The rotation of the spline bushing 620 is thus transferred to the sprocket 604, which is connected to the chain 564, driving the upper shaft 558.

Figure 18:
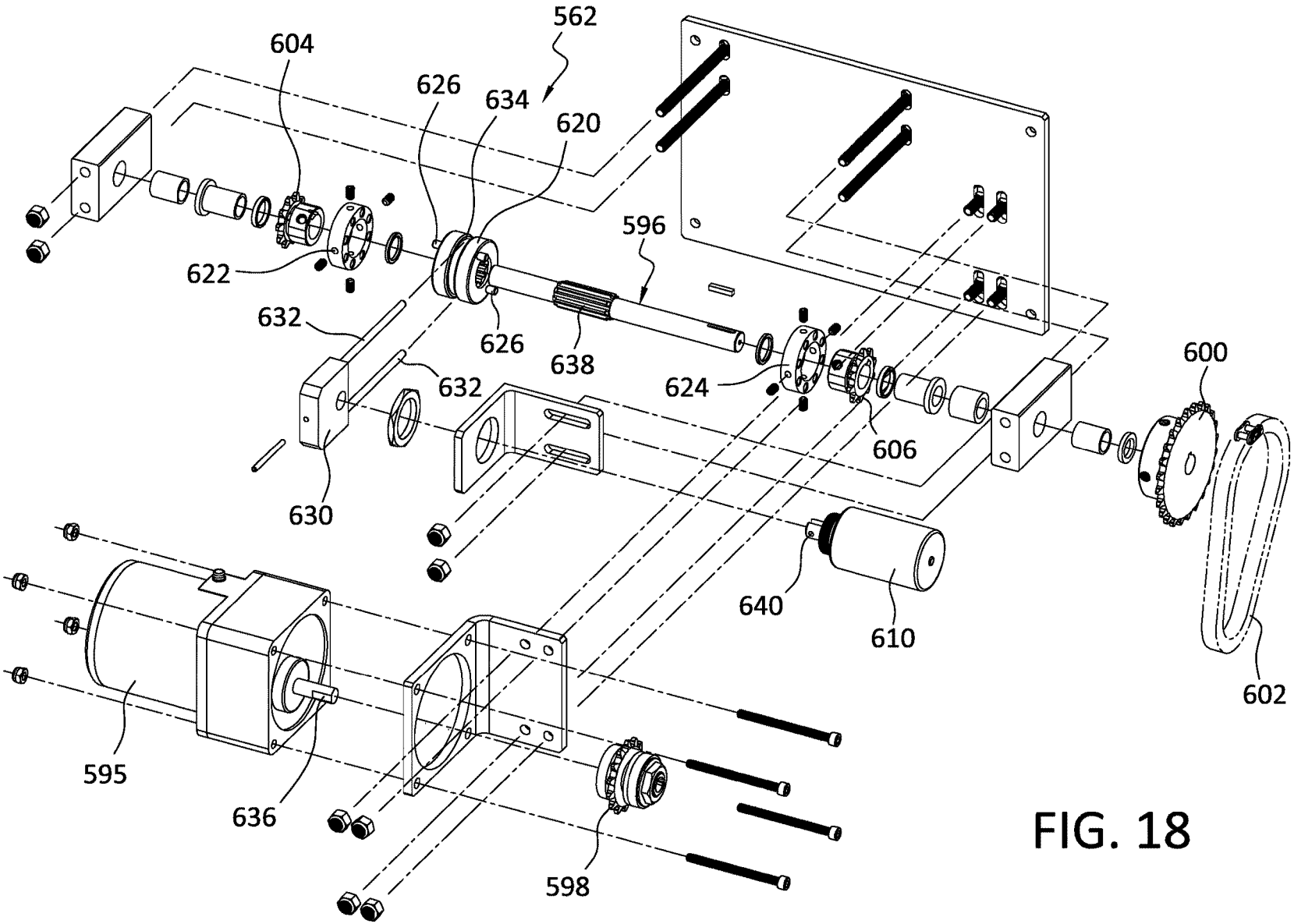
FIG. 18 is an assembly view of the motor drive.

Referring to FIG. 18, the motor drive 562 is shown in assembly. The sprocket 598 is fixedly connected to an output shaft 636 of the motor 595. The sprocket 598 drives the sprocket 600 via the chain 602 that connects both sprockets 598 and 600. The sprocket 600 drive the spline shaft 596, which includes a spline 638 that meshes with with internal spline in the spline bushing 620. The spline bushing 620 stays connected with the spline 638 as the spline bushing 620 moves axially of the spline shaft 596 to connect with the cog wheel 622 or the cog wheel 624. The cog wheel 622 is fixedly attached to the sprocket 604. The cog wheel 624 is fixedly attached to the sprocket 606. The rods 632 ride in the groove 634 so that extension or retraction of the solenoid 610 is effective to move the spline bushing axially of the spline shaft 596. The rods 632 are attached to the block 630, which is connected to the solenoid core 640. The core 640 is extended or retracted when the solenoid 610 is activated.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A cabinet, comprising:

a) a first shelf disposed inside the cabinet at a height above waist level, the first shelf having a first retracted position and a first deployed position below and outwardly from the first retracted position;

b) first and second pivot arms, first ends of the first and second pivot arms are pivotally operably attached to a first end of the first shelf, second ends of the first and second pivot arms are pivotally operably attached to the cabinet, the first and second pivot arms forming a first parallelogram;

c) third and fourth pivot arms, first ends of the third and fourth pivot arms are pivotally operably attached to a second end of the first shelf, second end of the third and fourth pivot arms are pivotally operably attached to the cabinet, the third and fourth pivot arms forming a second parallelogram;

d) a first shaft having a first end operably connected to one of the second ends of the first and second pivot arms, the first shaft having a second end operably connected to one of the second ends of the third and fourth pivot arms, the first shaft to pivot the first and second pivot arms and the third and fourth pivot arms to position the first shelf from the first retracted position to the first deployed position;

e) a second shelf disposed above the first shelf, the second shelf having a second retracted position and a second deployed position below and outwardly from the second retracted position;

f) fifth and sixth pivot arms, first ends of the fifth and sixth pivot arms are pivotally operably attached to a first end of the second shelf, second ends of the fifth and sixth pivot arms are pivotally operably attached to the cabinet, the fifth and sixth pivot arms forming a third parallelogram;

g) seventh and eighth pivot arms, first ends of the seventh and eighth pivot arms are pivotally operably attached to a second end of the second shelf, second ends of the seventh and eighth pivot arms are pivotally operably attached to the cabinet, the seventh and eighth pivot arms forming a fourth parallelogram;

h) a second shaft having a first end operably connected to one of the second ends of the fifth and sixth pivot arms, the second shaft to pivot the fifth and sixth pivot arms and the seventh and eight pivot arms to position the second shelf from the second retracted position to the second deployed position;

i) a drive motor;

j) a third shaft operably connected to the drive motor; and k) a clutch to selectively connect the third shaft to the first shaft or the second shaft to operate the first shelf or the second shelf.

2. The cabinet as in claim 1, wherein:

a) the clutch includes a solenoid;

b) the third shaft includes a splined portion; and c) a splined bushing operably connected to the splined portion and the solenoid, the solenoid being operable to slide the splined bushing to a first position to operably connect the third shaft to the first shaft or to a second position to operably connect the third shaft to the second shaft.

3. The cabinet as in claim 1, and further comprising:

a) a fixed shelf disposed below the first shelf; and b) the first and second deployed positions are substantially on a same level as the fixed shelf.

4. A cabinet as in claim 1, and further comprising:

a) a U-shaped frame having a base and first and second sides extending transversely from the base;

b) the first side is operably associated with the first ends of the first shelf and the second shelf;

b) the second side is operably associated with the second ends of the first shelf and the second shelf; and c) the U-shaped frame is operably attached to the cabinet.

5. A cabinet as in claim 4, wherein:

a) the first parallelogram and the third parallelogram are operably attached to the first side; and b) the second parallelogram and the fourth parallelogram are operably attached to the second side.

6. A cabinet as in claim 4, wherein the drive motor is operably attached to the base.

7. A cabinet as in claim 4, wherein the first shaft and the second shaft are operably attached to the base.

8. A cabinet as in claim 1, wherein:

a) the first shelf includes a first side wall disposed at the first end and a second side wall disposed at the second end;

b) the first ends of the first and second pivot arms are operably attached to the first side; and c) the first ends of the third and fourth pivot arms are operably attached to the second side wall.

9. A cabinet as in claim 1, wherein:

a) the second shelf includes a first side wall disposed at the first end and a second side wall disposed at the second end;

b) the first ends of the fifth and sixth pivot arms are operably attached to the first side; and c) the first ends of the seventh and eighth pivot arms are operably attached to the second side wall.

10. A cabinet as in claim 1, wherein the second shelf in the second deployed position is lower than the first shelf in the first retracted position.

11. A shelf retrofit for a cabinet hung from a wall, comprising:

a) a U-shaped frame having a base and first and second sides extending transversely from the base;

b) first and second pivot arms, first ends of the first and second pivot arms are for being pivotally operably attached to a first end of a first shelf, second ends of the first and second pivot arms are pivotally operably attached to the first side, the first and second pivot arms forming a first parallelogram;

c) third and fourth pivot arms, first ends of the third and fourth pivot arms are for being pivotally operably attached to a second end of the first shelf, second end of the third and fourth pivot arms are pivotally operably attached to the second side, the third and fourth pivot arms forming a second parallelogram;

d) a first shaft operably attached to the base, the first shaft having a first end operably connected to one of the second ends of the first and second pivot arms, the first shaft having a second end operably connected to one of the second ends of the third and fourth pivot arms; and e) a drive motor operably attached to the base, the drive motor is operably connected to the first shaft to pivot the first and second pivot arms and the third and fourth pivot arms to position the first shelf from a retracted position to a deployed position;

f) a solenoid;

g) a second shaft including a splined portion, the second shaft being operably connected to the drive motor; and h) a splined bushing operably connected to the splined portion and the solenoid, the solenoid being operable to slide the splined bushing to a first position to operably connect the second shaft to the first shaft.

12. A shelf retrofit as in claim 11, and further comprising:

a) fifth and sixth pivot arms, first ends of the fifth and sixth pivot arms are for being pivotally operably attached to a first end of a second shelf, second ends of the fifth and sixth pivot arms are pivotally operably attached to the first side, the fifth and sixth pivot arms forming a third parallelogram;

b) seventh and eighth pivot arms, first ends of the seventh and eighth pivot arms are for being pivotally operably attached to a second end of the second shelf, second ends of the seventh and eighth pivot arms are pivotally operably attached to the second side, the seventh and eighth pivot arms forming a fourth parallelogram;

c) a third shaft operably attached to the base, the third shaft having a first end operably connected to one of the second ends of the fifth and sixth pivot arms, the third shaft having a second end operably connected to one of the second ends of the seventh and eighth pivot arms; and d) the splined bushing includes a second position to operably connect the second shaft to the third shaft.

13. A shelf retrofit as in claim 12, wherein:

a) the second ends of the fifth and sixth pivot arms are disposed below the second ends of the first and second pivot arms; and b) the second ends of the seventh and eighth pivot arms are disposed below the second ends of the third and fourth pivot arms.

14. A cabinet, comprising:

a) a first shelf disposed inside the cabinet at a height above waist level, the first shelf having a first retracted position and a first deployed position below and outwardly from the first retracted position;

b) a first parallelogram linkage pivotably operably attached to a first end of the first shelf and the cabinet;

c) a second parallelogram linkage pivotally operably attached to a second end of the first shelf and the cabinet;

d) a second shelf disposed above the first shelf, the second shelf having a second retracted position and a second deployed position below and outwardly from the second retracted position;

e) a third parallelogram linkage pivotably operably attached to a first end of the second shelf and the cabinet;

f) a fourth parallelogram linkage pivotally operably attached to a second end of the second shelf and the cabinet;

g) a first shaft operably connected to the first parallelogram linkage and the second parallelogram linkage, the first shaft to operate the first and second parallelogram linkages outwardly and downwardly to position the first shelf from the first retracted position to the first deployed position;

h) a second shaft operably connected to the third parallelogram linkage and the fourth parallelogram linkage, the second shaft to operate the third and fourth parallelogram linkages outwardly and downwardly to position the second shelf from the second retracted position to the second deployed position;

i) a drive motor; and j) a third shaft operably connected to the drive motor and selectively connected to the first shaft or the second drive shaft to position the first shelf or the second shelf from the respective first or second retracted position to the respective first or second deploy position.

15. A cabinet as in claim 14, wherein:

a) the first parallelogram linkage includes first and second brackets, the first bracket is operably attached to a first end of the first shelf, the second bracket is operably attached to the cabinet;

b) first and second pivot arms pivotably operably connected to the first bracket and the second bracket;

c) the second parallelogram linkage includes third and fourth brackets, the third bracket is operably attached to a second end of the first shelf, the fourth bracket is operably attached to the cabinet; and d) third and fourth pivot arms pivotably operably connected to the third bracket and the fourth bracket.

16. A cabinet as in claim 15, wherein:

a) the third parallelogram linkage includes fifth and sixth brackets, the fifth bracket is operably attached to a first end of the second shelf, the sixth bracket is operably attached to the cabinet;

b) fifth and sixth pivot arms pivotably operably connected to the fifth bracket and the sixth bracket;

c) the fourth parallelogram linkage includes seventh and eighth brackets, the seventh bracket is operably attached to a second end of the second shelf, the eighth bracket is operably attached to the cabinet; and d) seventh and eighth pivot arms pivotably operably connected to the seventh bracket and the eighth bracket.

17. A cabinet as in claim 14, and further comprising:

a) a U-shaped frame having a base and first and second sides extending transversely from the base;

b) the first side is operably associated with the first ends of the first shelf and the second shelf;

c) second side is operably associated with the second ends of the first shelf and the second shelf; and d) the U-shaped frame is operably attached to the cabinet.

18. A cabinet as in claim 14, and further comprising:

a) a fixed shelf disposed below the first shelf; and b) the first and second deployed positions are substantially on a same level as the fixed shelf.

19. A cabinet as in claim 14, and further comprising:

a) a solenoid;

b) the third shaft includes a splined portion; and c) a splined bushing is operably connected to the splined portion, the splined bushing is slidable along the splined portion to operably connect the third shaft to the first shaft or the second shaft.

20. A cabinet as in claim 14, wherein: the first shelf is disposed in the first deployed position in a common space as the second shelf is disposed in the second deployed position.

* * * * *